United States Patent [19]

Howes

[11] Patent Number: 4,641,784

[45] Date of Patent: Feb. 10, 1987

[54] FUEL INJECTION NOZZLES

[75] Inventor: Peter Howes, Gerrards Cross, England

[73] Assignee: Lucas Industries Public Limited Company, Birmingham, England

[21] Appl. No.: 603,909

[22] Filed: Apr. 25, 1984

[30] Foreign Application Priority Data

Jun. 8, 1983 [GB] United Kingdom ..... 8315717

[51] Int. Cl.[4] ..... F02M 61/00

[52] U.S. Cl. ..... 239/453; 239/533.8

[58] Field of Search ..... 239/453, 456, 459, 533.2–533.12, 239/89

[56] References Cited

U.S. PATENT DOCUMENTS 2,154,875 4/1939 Streby ..... 239/453
3,531,052 9/1970 Berlyn ..... 239/533.12 X
3,738,576 6/1973 O'Neill ..... 239/533.8
4,394,972 7/1983 Potter ..... 239/456 X

FOREIGN PATENT DOCUMENTS 804116 11/1958 United Kingdom .

*Primary Examiner*—Andres Kashnikow

[57] ABSTRACT

A fuel injection nozzle of the outwardly opening type includes a valve member having a head biased into contact with a seating by a coiled spring. Fuel under pressure applied to the valve member lifts the head from the seating to allow fuel flow through an outlet. The valve member has a spring retainer connected to it and which forms a piston slidable in a skirt member which forms a cylinder into and out of which fuel can flow through a port. The port is positioned to be progressively covered by the retainer member to form a hydraulic spring which assists the action of the coiled spring, as the valve head is lifted from the seating.

5 Claims, 2 Drawing Figures

FUEL INJECTION NOZZLES

This invention relates to fuel injection nozzles through which fuel can be supplied to a combustion chamber of an internal combustion engine, the nozzle being of the so-called outwardly opening type and comprising a valve member slidable in a bore, the valve member having a head shaped to co-operate with a seating and resilient means biasing the valve member to a closed position in which the head is in sealing engagement with the seating and in which flow of fuel from an inlet to an outlet is prevented.

The form of fuel spray required to be produced by a fuel injection nozzle depends on the type of combustion chamber and in one example the injection nozzle is required to supply a low energy spray during the initial delivery of fuel but finishing with a high energy spray. The energy of the fuel spray is dependent upon the pressure drop across the orifice which produces the spray and forms the outlet.

The object of the invention is to provide a fuel injection of the kind specified in a simple and convenient form.

According to the invention a fuel injection nozzle of the kind specified comprises means defining a piston slidable within a cylinder, a port through which fuel can flow into and out of said cylinder, said port in use being progressively closed as the valve head lifts away from the seating, the fuel in said cylinder forming a liquid spring acting to assist the action of said resilient means.

Figure 1:
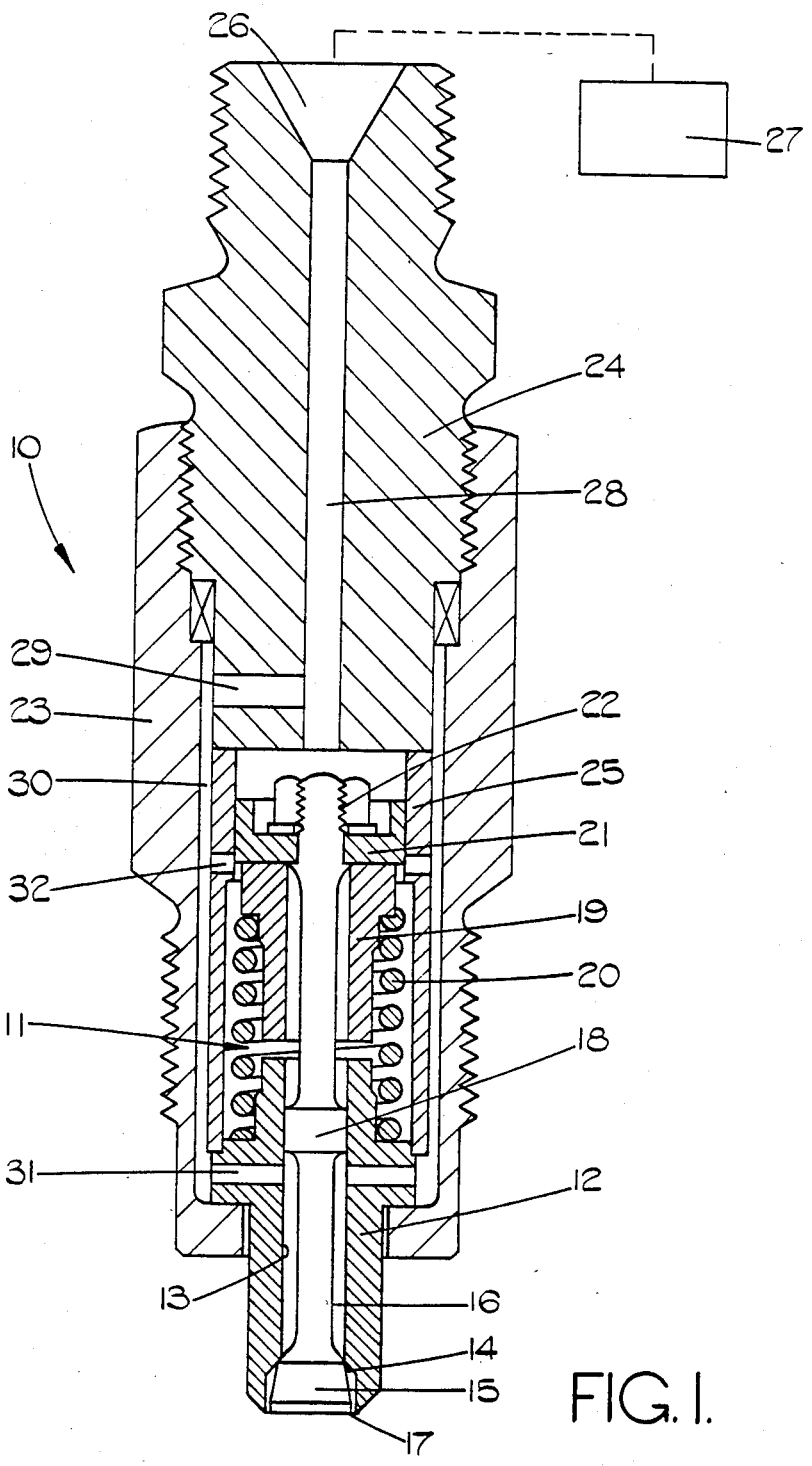
Figure 2:
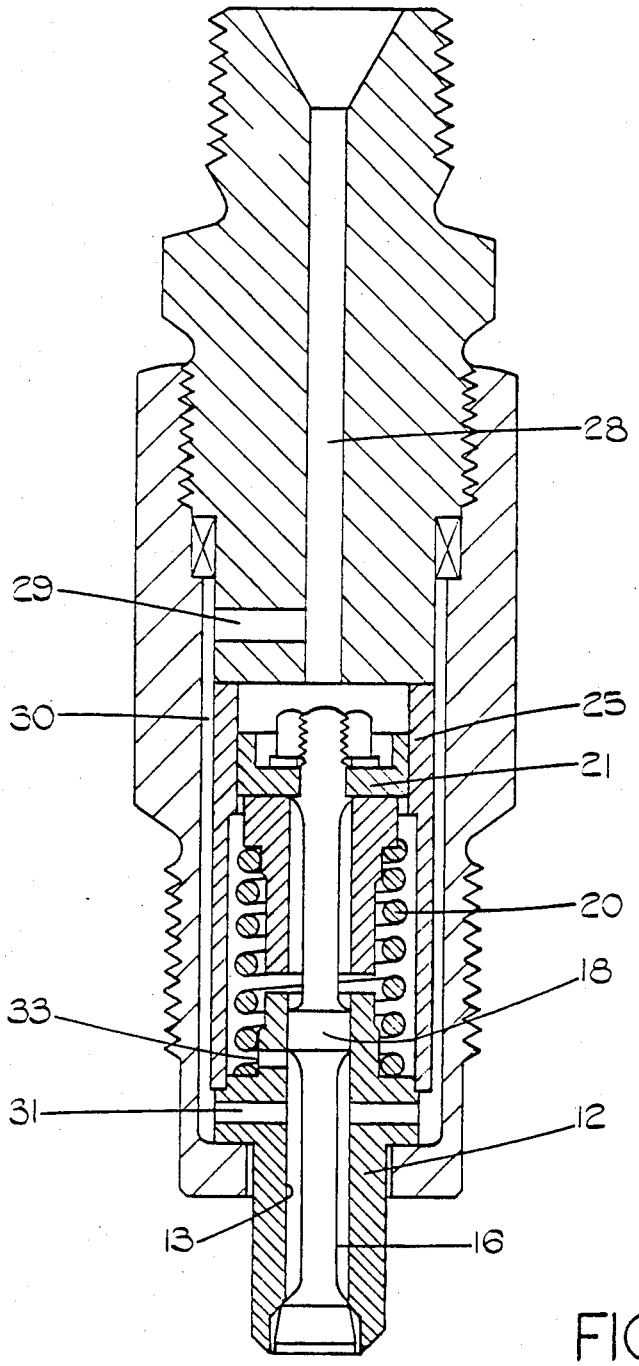

Two examples of fuel injection nozzles in accordance with the invention will now be described with reference to the accompanying drawings in which:

FIGS. 1 and 2 show the two nozzles respectively in sectional side elevation.

Referring to FIG. 1 of the drawings the nozzle is generally indicated at 10 and comprises a valve assembly generally indicated at 11. The valve assembly comprises a flanged body 12 in which is defined a bore 13. The bore 13 has an enlarged portion at the narrower end of the body, the enlarged portion defining a seating 14 of truncated conical form with which co-operates a valve head 15 which is carried upon a stem 16, the stem and the valve head forming a valve member. The valve head has an outer cylindrical portion which defines with the enlarged end portion of the bore an annular outlet 17 through which fuel can flow. The valve head has a tapered portion so that as the head emerges from the enlarged end of the bore the area of the annular outlet increases.

The main portion of the stem 16 is smaller than the bore but it is provided with an intermediate enlargement 18 to guide the movement of the stem. The stem extends beyond the end of the body and located about the stem is a spring abutment 19 between a step defined on which end the flange of the body 12 is a coiled compression spring 20. The abutment 19 is retained in position on the stem by means of a retainer 21 which is itself held in position by a fastening 22. In the closed position of the valve member as shown, a clearance exists between the adjacent ends of the abutment 19 and the body 12 and this clearance diminishes as the valve member moves to the open position, movement of the valve member being halted by the contact of the abutment with the body.

The valve assembly is located within a hollow housing 23, the reduced end portion of the body 12 extending through an aperture in the base wall of the housing. The housing is closed by a closure member 24 which is in screw thread engagement with the housing and intermediate the closure member 24 and the flange of the body is a hollow skirt member 25. The portion of the skirt member 25 adjacent the closure member 24 is of right cylindrical form and constitutes a cylinder within which is slidable a piston of which is constituted by the retainer member 21, the piston and cylinder forming a chamber.

The closure member 24 defines a fuel inlet 26 which is connected in use to an injection pump generally indicated at 27 and the fuel inlet by way of a passage 28, communicates with the space defined on the side of the retainer member remote from the spring. In addition, the passage 28 communicates by way of a radial passage or passages 29, with an annular space 30 defined between the skirt member 25 and the interior surface of the housing. The body 12 is provided with a plurality of ports 31 which connect the space 30 with the annular space intermediate the enlargement 18 and the head 15 and defined between the bore 13 and the reduced portion of the stem 16. In addition, the skirt portion 25 is provided with ports 32 which connect the space 30 with the chamber or cylinder disposed between the retainer member 21, the wall of the skirt member and the flange of the body 12. The ports 32 are so positioned that they will be progressively covered by the retainer member 21 as the valve head lifts from the seating.

In operation, when fuel under pressure is supplied by the injection pump 27 the fuel pressure acting on the valve assembly will move the valve member against the action of the spring 20 and fuel will flow through the ports 31 from the space 30 and through the outlet 17. The effective area over which the pressure acts is substantially equal to the area of the valve head 15. During the initial stages of delivery of fuel by the pump 27 the fuel pressure will be comparatively low so that the fuel spray which is generated at the outlet 17 will have a comparatively low energy. As the pressure continues to increase, the valve member will move further against the action of the spring 20 until the ports 32 are covered. When this occurs the fuel contained in the chamber which is bounded by the retainer member 21, the flange of the body 12 and the skirt member 25 will act as an hydraulic spring to assist the coiled compression spring 20 in resisting movement of the valve member. The pressure of fuel supplied by the injection pump will tend to increase but owing to the action of the fluid spring, the additional movement of the valve member will be comparatively small. The pressure drop across the outlet will therefore increase and the resulting spray will have a higher energy.

In the arrangement which is shown in FIG. 2, the ports 32 are omitted but their function is taken over by ports 33 which are formed in the body 12 and communicate with the annular clearance defined between the stem 16 of the valve member and the bore 13. In this example the enlargement 18 on the stem of the valve member acts to close the ports 33 as the valve head is lifted from the seating. When the ports 33 are closed the fuel in the chamber will act as an hydraulic spring and will assist the action of the coiled compression spring.

I claim:

1. A fuel injection nozzle through which fuel can be supplied to a combustion chamber of an internal combustion engine, the nozzle being of the so-called outwardly opening type and comprising a valve member slidable in a bore, the valve member having a head shaped to co-operate with a seating, resilient means biasing the valve member to a closed position in which the head is in sealing engagement with the seating and in which the flow of fuel from an inlet to an outlet is prevented, a hollow skirt member defining a cylinder, means defining a piston slidable within said cylinder between a first position and a second position, a port in said skirt member through which fuel can flow into and out of a chamber defined by said cylinder and said means defining said piston, said port in use being progressively covered by said piston as the valve head lifts away from the seating to be closed when said piston is in said second position to close said chamber and trap fuel in said closed chamber, the fuel in said closed chamber forming a liquid spring acting to assist the action of said resilient means.

2. A nozzle according to claim 1 in which the means defining the piston comprises a retainer which is mounted upon a stem of the valve member.

3. A nozzle according to claim 2 in which said retainer is slidable within one end of said hollow skirt member, said skirt member at its other end engaging a flange formed on a valve body in which the valve member is mounted, the retainer member engaging an abutment for one end of a coiled compression spring forming said resilient means, the other end of the spring engaging said flange.

4. A nozzle according to claim 3 in which said port is formed in said valve body and opens into a bore in the valve body in which the stem of the valve member is located, said stem having an enlargement which co-operates with the wall of the bore to guide the stem, said port being progressively covered by said enlargement as the valve head is lifted from the seating.

5. A fuel injection nozzle through which fuel can be supplied to a combustion chamber of an internal combustion engine, the nozzle being of the so-called outwardly opening type comprising: an outer housing; a fuel passage means mounted on said outer housing and fluidically connected to a fuel injection pump; a hollow skirt member fixedly mounted in said outer housing and having an internal bore and an outer surface, said outer surface being spaced from said outer housing to define an annular fuel space, said fuel passage means being fluidically connected to said hollow skirt internal bore; fuel passage means fluidically connecting said annular fuel space with said fuel passage means; fuel port means in said hollow skirt for fluidically connecting said annular fuel space with the said hollow skirt internal bore; piston means slidably mounted in said hollow skirt internal bore to be moved by the pressure of fuel in said internal bore from a first position to a second position, said piston means including a fuel port closure means located adjacent to said fuel port means for progressively covering said fuel port means and for closing said fuel port means when said piston means is in said second position, said fuel port means being open when said piston means is in said first position, said piston means having an outer surface spaced from said skirt member to define a control chamber, said control chamber being fluidically connected to said annular fuel space by said fuel port means to be closed when said fuel port means is closed; a valve mounted on said piston means to be movable therewith; a fuel outlet chamber fluidically connected to said annular fuel space to receive fuel therefrom, said fuel outlet chamber having an outlet means which is closed by said valve when said piston means is in said first position and which is progressively opened as said piston means moves away from said first position; resilient biasing means on said piston means resiliently resisting movement of said piston means in a direction which opens said outlet means; and hydraulic coupling means formed by fuel trapped in said control chamber when said control chamber is closed for assisting said resilient biasing means in resisting movement of said piston means in the direction which opens said outlet means.

* * * * *